US005837131A

United States Patent [19]

Clark

[11] Patent Number: 5,837,131

[45] Date of Patent: Nov. 17, 1998

[54] DESULFURIZATION PROCESS

[75] Inventor: Peter David Clark, Calgary, Canada

[73] Assignee: University Technologies International Inc., Calgary, Canada

[21] Appl. No.: 628,754

[22] Filed: Apr. 5, 1996

[51] Int. Cl.[6] ..... C10G 45/04

[52] U.S. Cl. ..... 208/216 PP; 208/208 R

[58] Field of Search ..... 208/208 R, 216 PP

[56] References Cited

U.S. PATENT DOCUMENTS

| | | | |
|---|---|---|---|
| 4,665,273 | 5/1987 | Johnson et al. | 585/739 |
| 4,677,093 | 6/1987 | Devanneaux | 502/220 |
| 4,789,462 | 12/1988 | Byrne et al. | 208/213 |
| 4,990,242 | 2/1991 | Louie et al. | 208/218 |
| 5,055,179 | 10/1991 | Tyrer | 208/208 R |
| 5,157,201 | 10/1992 | Norris | 208/208 R |
| 5,171,425 | 12/1992 | Muller | 208/208 R |
| 5,183,560 | 2/1993 | Roof et al. | 208/208 R |
| 5,183,561 | 2/1993 | Kresge et al. | 208/25 R |
| 5,344,553 | 9/1994 | Shih | 208/213 |
| 5,401,341 | 3/1995 | Collins | 208/208 R |
| 5,605,619 | 2/1997 | Holt | 208/208 R |
| 5,626,742 | 5/1997 | Brons et al. | 208/208 R |

FOREIGN PATENT DOCUMENTS

| | | | |
|---|---|---|---|
| 2081758 | 5/1993 | Canada | C10G 45/04 |

*Primary Examiner*—Helane Myers
*Attorney, Agent, or Firm*—Anthony R. Lambert

[57] ABSTRACT

A method for desulfurizing a light sour oil by contacting the hydrocarbon fluid with a mesoporous catalyst at temperatures in the range of 20°–500° C. in the absence of molecular hydrogen to promote carbon—carbon and carbon-sulfur bond formation and increase the boiling point of sulfur containing hydrocarbons. The mesoporous catalyst is selected from the group consisting of alumina-silicate, alumina and silica, and is impregnated with an oxide of a metal that forms coordinate bonds with hydrocarbons in the hydrocarbon fluid. Suitable metals are aluminium, scandium, titanium, vanadium, chromium, manganese, iron, cobalt, nickel, copper and zinc. The hydrocarbon fluid may be contacted with the mesoporous catalyst in the presence of up to about 1 mole oxygen for each mole of sulfur in the sulfur containing hydrocarbons, or in the presence of an unsaturated hydrocarbon. Subsequent distillation separates the hydrocarbon fluid into a first fraction and a second fraction, wherein the first fraction contains hydrocarbons generally having a lower boiling point than hydrocarbons in the second fraction, and the second fraction includes a higher mass percentage of sulfur than the first fraction.

29 Claims, No Drawings

DESULFURIZATION PROCESS

FIELD OF THE INVENTION

This invention relates to methods for the desulfurization of hydrocarbons.

BACKGROUND OF THE INVENTION

In oil refining, catalytic cracking of sour gas oils leads to naphthenes and light distillate products which contain residual sulfur compounds such as mercaptans, sulfides, disulfides and thiophenes. Removal of these unwanted sulfur compounds by conventional catalytic hydrodesulfurization processes also results in the saturation of alkenes produced in the upstream refining operations. Reduction or loss of the alkenes is undesirable as it results in a lowering of the octane number of the resultant sulfur free hydrocarbon.

Likewise, low boiling (20°–300° C.) hydrocarbon mixtures obtained during the recovery of natural gas containing the aforementioned sulfur compounds must be desulfurized using catalysts and hydrogen at high pressure before they can be used as fuels for transportation and in industrial processes.

A further problem in handling refinery hydrocarbon streams, gas condensates and crude oils results from the odours caused by mercaptan and other sulfur compound constituents of the materials. Although some absorbents, such as zinc oxide and the like, can be used to alleviate odours, such absorbents are expensive and cause disposal problems. Odours emanating from liquid hydrocarbons caused by sulfur compounds can also be removed by catalytic hydrogenation. However, this method of odour reduction requires high pressure hydrogen, expensive catalysts and the application of pressure vessels.

SUMMARY OF THE INVENTION

In the present invention, methods are described for the removal of sulfur compounds from hydrocarbon streams and for the removal and reduction of odours of hydrocarbon-based materials. In one aspect of the invention, a method for desulfurization of sulfur-containing hydrocarbon fluids includes treating the sulfur-containing hydrocarbons with a mesoporous catalyst at temperatures in the range of 20°–500° C. The action of the catalyst is to promote C—C (carbon—carbon) and C—S (carbon-sulfur) bond-forming reactions to form higher molecular weight sulfur containing compounds. These higher molecular weight and, thus, higher boiling point products may be subsequently removed by distillation and separation of the hydrocarbons into higher and lower boiling point fractions. Thus, overall, the process concentrates sulfur compounds, which, ordinarily, are distributed over the whole boiling range of a hydrocarbon mixture, to the high boiling fraction of the material. Distillation of the treated hydrocarbon mixture results in a sulfur-free lower boiling point stream, which may consist of >95 volume % of the original material and a high sulfur-content high boiling residue. This residue may be disposed of by co-feeding it with gas oils to standard catalytic hydrocrackers.

An important feature of the process is that it does not require the use of molecular hydrogen. As a consequence, only low pressure reactors are required to conduct the desulfurization. In addition, it is not necessary to remove air from the reacting system. In some applications, the incorporation of oxygen can be beneficial to the C—C and C—S bond form of reactions needed to accomplish the desulfurization process.

A further refinement of the process is to add a reactive unsaturated hydrocarbon such as an alkene or aromatic to the hydrocarbon-catalyst mixture. These additives provide substrates for reactions with sulfur compounds, enhancing the conversion of sulfur compounds to high molecular weight, high boiling point products.

When the invention is practised to control the sulfurous odours of hydrocarbon materials, the hydrocarbon mixture is contacted with a mesoporous catalyst at temperatures in the 20°–500° C. range over time periods from one minute up to one hour. The product is isolated by separation from the catalyst. The odour of the hydrocarbon mixture is reduced or removed as a result of C—C and C—S bond forming reactions which convert odiferous, high vapour pressure sulfur compounds to higher molecular weight, less odiferous sulfur compounds with lower vapour pressures.

The catalyst for either desulfurization or odour reduction processes may consist of any mesoporous alumina-silicate, alumina or silica, and may be natural or synthetic. In a preferred embodiment of the processes, the catalyst materials are prepared by impregnation with transition metal salts or salts of aluminium. Salts of zinc and iron are particularly effective in promoting the activity of the catalyst. These salts are impregnated onto the catalyst support in concentrations of 0.1 to 3 mmol per gram of support using standard procedures for preparation of catalysts. Particularly active catalysts are those prepared from K-10 montmorillonite and zinc chloride or zinc citrate. Other mesoporous substrates, such as the MCM™ series of synthetic alumina-silicates described by the Mobil Corporation are also effective catalysts when promoted with transition metal salts. All of these catalysts have increased activity when activated by heating in air at 150°–450° C.

DETAILED DESCRIPTION OF PREFERRED EMBODIMENTS

In the practice of the invention, a sulfur containing hydrocarbon fluid, preferably a fluid containing predominantly hydrocarbons having a boiling point of lower than 350° C., and preferably a light oil, naphtha or condensate, is contacted with a mesoporous catalyst in a sealed vessel at a temperature of about 20° to 500° C. In this context, mesoporous means that the pore size of the catalyst is large enough that sulfur containing hydrocarbon molecules and other reactants can be accommodated in the pores containing the active catalytic sites. If the pore size cannot hold the reacting species in their reaction transition states, then the reaction cannot proceed. In addition, the pore size cannot be so large that reduced surface area of the catalyst due to the large pore size makes the process inefficient. Pore diameters preferably range from 20 Angstroms to 200 Angstroms. Pores with such a diameter allow diffusion of the sulfur containing hydrocarbons into the catalyst. While catalysts with pore diameters up to 1000 Angstroms may work, at this pore diameter the pores become so large that undesirable polymerization process may occur.

Molecular hydrogen should not be present in any significant quantities during the catalytic reaction since the presence of molecular hydrogen tends to break down C—C bonds and C—S bonds rather than create them. Preferably, the reaction takes place only in the presence of the hydrocarbon fluid, inert compounds that have no effect on the C—C and C—S bond formation, and, in some instances, oxygen.

The catalyst may be an alumina-silicate, alumina or silica, prepared in conventional fashion. For example, the catalysts may be prepared from a natural clay of the montmorillonite class, such as K-10 montmorillonite as supplied by the Fluka Chemical Company or other suppliers using conventional procedures. The catalyst should be prepared by impregnating it with a salt of aluminum or a transition metal. These metals have the property that they form coordinate bonds with sulfur containing hydrocarbons in the hydrocarbon fluid. When the catalyst is impregnated with the metal salt, it leaves a metal oxide in the pores of the catalyst. Impregnation is carried out by adding a solution of the desired salt, for example zinc chloride, zinc acetate or zinc citrate, in methanol or other suitable solvent to the catalyst. After stirring the catalyst-solution mixture, the methanol solvent is removed by rotary evaporation and the resulting powder formed into pellets using conventional methods. The catalyst is then activated in air at temperatures of 150°–450° C. depending on the type of substrate and metal salt used.

Preferred substrates are mesoporous (30–150 Å) montmorillonite clays, and other mesoporous alumina-silicates including MCM™ synthetic alumina-silicates. The catalyst should have a surface area of up to 300 $m^2/g$, preferably greater than 100 $m^2/g$, and may be for example about 220 $m^2/g$. Preferred salts are zinc, iron and copper salts although other transition metal salts and those of aluminium produce active catalysts. For desulfurization of thiophenes, aluminium is preferably used as an active catalyst. For desulfurization of disulfides, copper is preferably used as an active catalyst.

Practical limits on the ratio of condensate to catalyst have not been determined, but it is known that the desulfurization process will work with condensate to catalyst weight ratios of between 1:1 and 100:1.

In a typical desulfurization procedure, a liquid hydrocarbon mixture containing sulfur compounds (100 ppmw—2 weight % total sulfur) is passed through a reactor holding the catalyst and maintained at 20°–450° C. Depending on the feedstock and temperature, a residence time of a few seconds to 60 minutes may be required. Any reactor suitable for contacting liquids with heterogeneous catalysts is suitable. The reactor need only withstand the vapour pressure of the sulfur-containing hydrocarbon mixture being treated.

One option of carrying out the process is to over-pressure the reactor with air or oxygen in quantities such that the molar quantity of oxygen is in slight excess in comparison to the molar amount of mercaptans and disulfides in the hydrocarbon mixture. In this case, the reactor must be able to withstand the over-pressure of the air or oxygen.

Another option of carrying out the desulfurization process is to add a molar amount of alkene, aromatic or other unsaturated hydrocarbon, with respect to the number of moles of total sulfur in the hydrocarbon mixture, to the hydrocarbon feedstock—catalyst mixture and treat the mixture as specified previously. The alkene or unsaturated additive may be of any structure but preferably a compound with a boiling point in excess of 100° C.

After any of the previously described treatments, the liquid product is separated from the catalyst and is subjected to a suitable distillation procedure to remove the volatile fraction, usually 90–99 vol %, of the product. The distillation residue may be collected and recycled to a gas oil hydrotreater.

In a typical odour removal procedure, the same process is followed. However, when odour removal is the objective, no distillation is necessary and only separation of hydrocarbon mixture from the catalyst is required.

EXAMPLES

An exemplary method for removing sulfur compounds from gas condensates is accomplished by passing sour condensate ($S_{TOT}$=0.8%) over a bed of catalyst, K10/$ZnCl_2$ at 150° C. and distilling the product to produce a low sulfur product and higher boiling, sulfur-rich residue. It should be noted that while the catalyst has been described as a $ZnCl_2$ catalyst, this means that the catalyst is formed by impregnation of $ZnCl_2$ into the catalyst, resulting in the formation of a ZnO/catalyst mixture after calcination of the catalyst.

In one example, 90–95 vol. % of the gas condensate distillate was recovered with sulfur content below 0.1%. Further examples are shown in the Table:

TABLE 1

Examples of the Invention

| No. | Catalyst Type | T° C. | t(min) | Additive |
|---|---|---|---|---|
| 1. | K-10/$ZnCl_2$ | 150 | 30 | None |
| 2. | None | 150 | 30 | None |
| 3. | K-10/$ZnCl_2$ | 150 | 30 | None |
| 4. | None | 150 | 30 | None |
| 5. | K-10/$ZnCl_2$ | 150 | 30 | None |
| 6. | None | 150 | 30 | None |
| 7. | K-10/$ZnCl_2$* | 150 | <1 | None |

| No. | Wt % S(int)[1] | Wt % S(95%)[2] | Wt % S(5%)[3] |
|---|---|---|---|
| 1. | 0.18 | <0.005 | 1.18 |
| 2. | 0.18 | 0.057 | 1.48 |
| 3. | 0.12 | 0.0058 | 0.12 |
| 4. | 0.12 | 0.035 | 0.267 |
| 5. | 0.738 | 0.032 | 6.57 |
| 6. | 0.738 | 0.211 | 6.20 |
| 7. | 0.738 | 0.067 | 7.85 |

*Continuous flow experiment. Examples 1–6 were done in batch reactors.
[1]Sulfur content of whole feedstock.
[2]Sulfur content of 95% distillate of product.
[3]Sulfur content of 5% distillate residue.

It is believed that the removal of sulfur compounds from the sour condensate occurs by three mechanisms:

1. Sulfur compounds are physically absorbed onto the clay.

Removal Mechanism 1

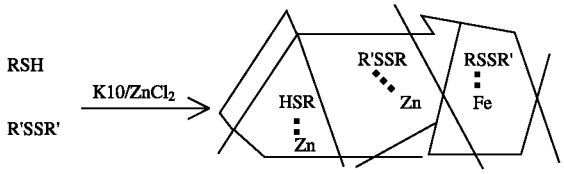

There are a significant number of other metals present in the clay in trace quantities (e.g. Fe) that are also capable of binding sulfur compounds to the clay surface. At present, it is not exactly known how such physisorption affects chemical reactions at the clay surface but it is believed that larger molecules fill the pore structure of the clay and deactivate it. Physisorption of sulfur compounds at the clay surface is, however, a pre-requisite for chemical reaction.

2. Sulfur compounds react together to form larger sulfur compounds containing twice (or possibly more) the amount of sulfur.

Removal Mechanism 2

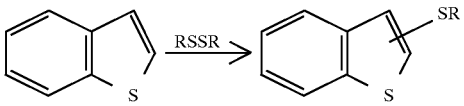

3/2 R'SSR' + 3/2 RSSR ⟶ RSSR' + R'SSSR' + RSR

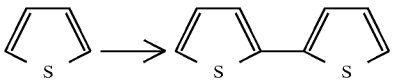

(aromatic coupling)

The clay catalyst may be designed to promote the various types of reactions. A sulfur compound undergoing such reactions would increase: a) its mass, therefore its boiling point and b) its sulfur content. Therefore, when a sour gas condensate has been reacted with the clay and then undergoes a distillation process, these heavy sulfur compounds would remain behind in a "sulfur rich" distillate residue. Our experience has shown that the smaller the residue fraction, the higher is its sulfur content.

3. Sulfur compounds react with aromatics.

Removal Mechanism 3

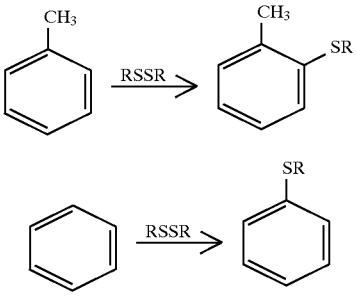

Disulfides react with aromatics within the condensate to form higher molecular weight compounds. Since the percentage of sulfur in the sour condensate is low (~1%), only a small percentage of aromatic compounds will be consumed in this process.

The following are model reactions for the generation of higher boiling point/higher molecular weight products.

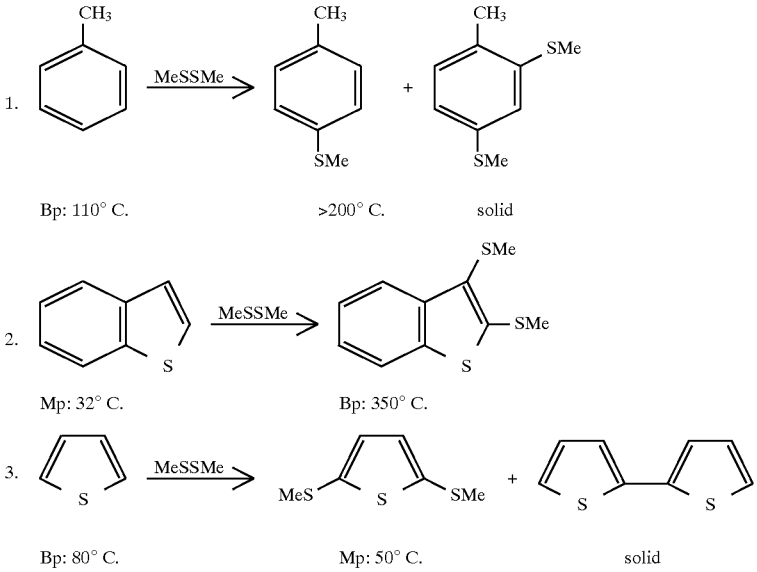

These reactions show that low molecular weight/low boiling point thiols, disulfides, aromatics and sulfur aromatics, react with each other and lead to significantly higher molecular weight/boiling point products.

The mechanism of reaction is important to the success of the process. A reasonable pathway for reaction of a thiol with an aromatic is set out below:

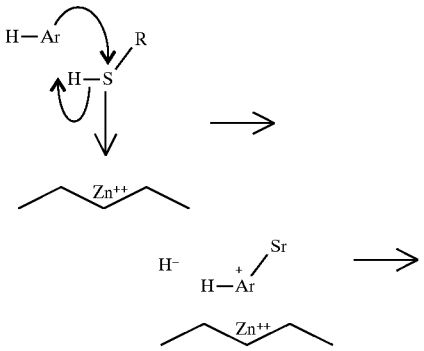

-continued

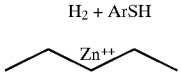

The first step involves reaction of a coordinated thiol with an aromatic. This step involves loss of hydride ion from the thiol and, ultimately, formation of $H_2$. In reality, this step is not very likely (high $E_A$) and $H_2$ has not been observed in the reactions. It is believed that $O_2$, from air trapped in catalyst pores, removed "H" from the thiol by a radical mechanism producing $H_2O$ as the final product. In laboratory model compound reactions, it has been shown that reactions 1, 2 and 3 slow and stop unless air is present in the system. Thus, for some feedstocks it may be necessary to introduce a few ppmw air to assist selected chemical reactions. Note, however, that the requirement for air will be feedstock dependent as some reactions do not require $O_2$ to proceed.

In a further example, No. 1 Alberta Condensate, with untreated %S=0.034% w/w, was refluxed with clay catalyst in a 10:1 (condensate:clay) ratio for 30 minutes. Upon filtering, the value of the sulfur content ($6.69\times10^{-6}$ wt %) was sufficient and no distillation was necessary.

In another example, No. 2 Alberta Condensate with untreated sulfur content %S=0.738, distilled 90% fraction %S=0.211 w/w, distilled 10% fraction %S=6.20 w/w, was reacted with the clay catalyst in a 10:1 (condensate:clay) ratio at 150° C. in an autoclave. The reaction was stirred for ½ hour and was distilled to yield a 93% lower boiling point fraction containing 0.0316% w/w sulfur, as compared to the unreacted condensate whose 90% lower boiling point fraction had a sulfur content of 0.211% w/w.

The following table summarizes sulfur weight percentage of lower (90%) and higher (10%) boiling point fractions after treatment of various cuts of a sour condensate.

| Continuous Flow experiment | | Sulfur Content of Distillation fractions | |
|---|---|---|---|
| (No. 2: Alberta Condensate) | | 90% | 10% |
| Cut #1 | % S = ~0.40 | | |
| Cut #2 | % S = ~0.45 | | |
| Cut #3 | % S = ~0.55 | | |
| Cut #4 | % S = 0.624 | 0.0669 | 7.85 |
| Cut #5 | % S = 0.707 | 0.165 | 8.22 |
| Cut #6 | % S = 0.738 | 0.17 | 8.52 |
| Cut #7 | % S = 0.734 | 0.189 | 9.30 |

The No. 2 Alberta condensate was reacted in a continuous flow apparatus with a stationary bed of the clay catalyst, at a temperature of 150° C. The amount of condensate used in this reaction approached a 20:1 (condensate:clay) ratio. The last four cuts were distilled and their sulfur content was measured.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A method for the desulfurization of a hydrocarbon fluid, the hydrocarbon fluid including sulfur containing hydrocarbons, the method comprising:

contacting the hydrocarbon fluid with a mosoporous catalyst having a pore diameter of between 20 and 200 Angstroms at temperatures in the range of 20°–500° C. to promote C—C and C—S bonding and increase the boiling point of the sulfur containing hydrocarbons.

2. The method of claim 1 in which the hydrocarbon fluid is contacted with the mesoporous catalyst for time periods from one minute up to one hour.

3. The method of claim 1 in which the mesoporous catalyst is selected from the group consisting of alumina-silicate, alumina and silica.

4. The method of claim 3 further comprising, before contacting the hydrocarbon fluid with the mesoporous catalyst, impregnating the mesoporous catalyst with salts selected from the group consisting of salts of the metals aluminium, scandium, titanium, vanadium, chromium, manganese, iron, cobalt, nickel, copper and zinc in amounts of about 0.1 to 3 mmol of metal per gram of catalyst.

5. The method of claim 4 in which the hydrocarbon fluid is contacted with the mesoporous catalyst in the presence of up to about 1 mole oxygen for each mole of sulfur in the sulfur containing hydrocarbons.

6. The method of claim 4 further comprising the step of:

adding an unsaturated hydrocarbon to the hydrocarbon fluid in an amount up to the molar quantity of sulfur in the sulfur containing compounds.

7. The method of claim 6 in which the unsaturated hydrocarbon is selected from the group comprising alkenes and aromatics.

8. The method of claim 4 further comprising, after contacting the hydrocarbon fluid with the mesoporous catalyst:

distilling the hydrocarbon fluid to separate the hydrocarbon fluid into a first fraction and a second fraction, wherein the first fraction contains hydrocarbons generally having a lower boiling point than hydrocarbons in the second fraction, and the second fraction includes a higher mass percentage of sulfur than the first fraction.

9. The method of claim 4 in which the mesoporous catalyst is a natural clay.

10. The method of claim 4 in which the mesoporous catalyst is a clay of the montmorillonite class.

11. The method of claim 3 in which the mesoporous catalyst is a clay of the montmorillonite class.

12. The method of claim 1 in which the mesoporous catalyst has pore diameters between about 30 Angstroms and 150 Angstroms.

13. The method of claim 1 in which the mesoporous catalyst comprises an oxide of a metal, wherein the metal has the property that it forms coordinate bonds with sulfur containing hydrocarbons in the hydrocarbon fluid.

14. The method of claim 13 in with the hydrocarbon fluid is contacted with the mesoporous catalyst in the presence of up to about 1 mole oxygen for each mole of sulfur in the sulfur containing hydrocarbons.

15. The method of claim 13 further comprising the step of:

adding an unsaturated hydrocarbon to the hydrocarbon fluid in an amount up to the molar quantity of sulfur in the sulfur containing compounds.

16. The method of claim 15 in which the unsaturated hydrocarbon is selected from the group comprising alkenes and aromatics.

17. The method of claim 13 further comprising, after contacting the hydrocarbon fluid with the mesoporous catalyst:

distilling the hydrocarbon fluid to separate the hydrocarbon fluid into a first fraction and a second fraction, wherein the first fraction contains hydrocarbons generally having a lower boiling point than hydrocarbons in the second fraction, and the second fraction includes a higher mass percentage of sulfur than the first fraction.

18. The method of claim 13 in which the mesoporous catalyst is a natural clay of the montmorillonite class.

19. A method for desulfurizing a hydrocarbon fluid, in which the hydrocarbon fluid contains predominantly hydrocarbons having a boiling point of less than about 350° C., the hydrocarbons including sulfur containing hydrocarbons, the method comprising the steps of:

contacting the hydrocarbon fluid with a mesoporous catalyst having a pore diameter between 20 and 200 Angstroms at temperatures in the range of 20°–500° C. in the absence of molecular hydrogen, wherein the mesoporous catalyst is selected from the group consisting of alumina-silicate, alumina and silica and the mesoporous catalyst includes an oxide of a metal that forms coordinate bonds with sulfur containing hydrocarbons in the hydrocarbon fluid.

20. The method of claim 19 in which the metal is selected from the group consisting of aluminium, scandium, titanium, vanadium, chromium, manganese, iron, cobalt, nickel, copper and zinc.

21. The method of claim 20 in which the metal is present in amounts of about 0.1 to 3 mmol of metal per gram of catalyst.

22. The method of claim 21 further comprising the step of, before contacting the hydrocarbon fluid with the mesoporous catalyst, impregnating the mesoporous catalyst with a salt of the metal to create the metal oxide within mesoporous catalyst.

23. The method of claim 19 in which the hydrocarbon fluid is contacted with the mesoporous catalyst in the presence of up to about 1 mole oxygen for each mole of sulfur in the sulfur containing hydrocarbons.

24. The method of claim 23 further comprising, after contacting the hydrocarbon fluid with the mesoporous catalyst:

distilling the hydrocarbon fluid to separate the hydrocarbon fluid into a first fraction and a second fraction, wherein the first fraction contains hydrocarbons generally having a lower boiling point than hydrocarbons in the second fraction, and the second fraction includes a higher mass percentage of sulfur than the first fraction.

25. The method of claim 19 further comprising the step of:

adding an unsaturated hydrocarbon to the hydrocarbon fluid in an amount up to the molar quantity of sulfur in the sulfur containing compounds.

26. The method of claim 25 in which the unsaturated hydrocarbon is selected from the group comprising alkenes and aromatics.

27. The method of claim 19 further comprising, after contacting the hydrocarbon fluid with the mesonorous catalyst:

distilling the hydrocarbon fluid to separate the hydrocarbon fluid into a first fraction and a second fraction, wherein the first fraction contains hydrocarbons generally having a lower boiling point than hydrocarbons in the second fraction, and the second fraction includes a higher mass percentage of sulfur than the first fraction.

28. The method of claim 27 further comprising contacting the hydrocarbon fluid with the mesoporous catalyst for time periods from one minute up to one hour.

29. The method of claim 19 in which the mesoporous catalyst is a natural clay of the montmorillonite class .

* * * * *